United States Patent [19]

Lange et al.

[11] 3,988,584

[45] Oct. 26, 1976

[54] ARRANGEMENT FOR THE ELECTRO-PHOTOGRAPHIC TAKING OF RADIOSCOPIC PICTURES

[75] Inventors: Gottfried Lange; Karl Hans Reiss, both of Erlangen, Germany

[73] Assignee: Siemens Aktiengesellschaft, Erlangen, Germany

[22] Filed: Feb. 25, 1975

[21] Appl. No.: 552,779

[30] Foreign Application Priority Data

Feb. 28, 1974 Germany ..... 2409712

[52] U.S. Cl. ..... 250/315 A; 250/327

[51] Int. Cl.[2] ..... G03G 15/00

[58] Field of Search ..... 250/315 A, 327, 315 R

[56] References Cited

UNITED STATES PATENTS 3,057,997 10/1962 Kaprelian ..... 250/315 R 3,774,029 11/1973 Muntz et al. ..... 250/315 A 3,813,546 5/1974 Proudian ..... 250/315 A

*Primary Examiner*—Alfred E. Smith

*Assistant Examiner*—T. N. Grigsby

*Attorney, Agent, or Firm*—Haseltine, Lake & Waters

[57] ABSTRACT

An arrangement for the electro-photographic recording or taking of radioscopic pictures. The arrangement for the electro-photographic taking of radioscopic pictures provides a constant level of illumination which is independent of current requirements. The object is attained by providing a support for the exposure or photographic layer with mutually insulated, electrically conductive layers between which there is located the exposure layer, and wherein the two conductive layers are connected to an installation for controlling the source of the transilluminating radiation.

2 Claims, 6 Drawing Figures

ARRANGEMENT FOR THE ELECTRO-PHOTOGRAPHIC TAKING OF RADIOSCOPIC PICTURES

FIELD OF THE INVENTION

The present invention relates to an arrangement for the electro-photographic recording of radioscopic pictures.

DISCUSSION OF THE PRIOR ART

An arrangement for the electro-photographic recording or taking of radioscopic pictures, which consists of an electrically insulating exposure layer and a support which maintains this layer in the beam of the transilluminating rays, is already known from the treatise "Xeroradiography" by J. W. Boag in "Phys. Med. Biol." 18 (1973) Number 1., pages 3 through 37, and particularly page 25.

In accordance with the above-mentioned literature source, an electro-photographic exposure layer, meaning, an insulating layer which becomes electrically conductive upon irradiation with X-rays, is located between areal or laminar electrodes in order to avoid the so-called "xerographic undercutting." In this connection, the foregoing deals with rendering harmless the effect of the ions which disrupt the electrostatic image, and which occur in the space ahead of the plate. For this purpose, a direct voltage is applied to the electrodes. This voltage is so polarized whereby the ions which are produced in the vapor space do not reach the photo conductive layer, meaning, such as the selenium (Se) surface of the xerographic plate and to there exert charge fluctuations. Arrangements of this type, however, as all others, evidence the disadvantage in that the electro-radiographic radioscopic pictures must each time be differently illuminated in dependence upon currently present requirements, such as radiation dosage, radiation density, different plate sensitivities and so forth. These illuminating parameters must be extremely precisely maintained, inasmuch as otherwise this would result in faulty illuminations. Furthermore, in arrangements in which the charge image is built on a pure insulating layer, in the so-called ionography, there is present the desire for the exact maintenance of the illuminating values, sine also in this instance excessively high dosages lead to faulty illuminations. Distinction with respect to known automatic X-ray illuminating devices are, for example, the introduction of a signal transmitter into the exposure system, and the processing of the specific sensitivity of the radiation receiver.

Summary of the Invention

Accordingly, it is an object of the present invention to provide, in an arrangement for the electro-photographic recording or taking of radioscopic pictures of the previously mentioned type, a constant level of illumination which is independent of current requirements. The foregoing object is inventively attained by providing the support for the exposure or photographic layer with mutually insulated electrically conductive layers between which there is located the exposure layer, and wherein the two conductive layers are connected to an installation for controlling the source of the transilluminating radiation.

Through the inventive employment of electrically conductive coatings there are utilized signals for the control of the illumination which depend upon the requirements present during the exposure, as has already been indicated hereinabove. False illuminations are thereby extensively avoided. By means of the additional application of a corresponding bias voltage, there may in addition thereto be also avoided the known undercutting of the images, inasmuch as the generated atmospheric ions are evacuated. A further advantage of the invention consists of in that no auxiliary ionization chamber need be located preceding the exposure arrangement. Any additional absorption is avoided.

The operative effect of the invention, in utilization with a common xerographic plate, rests in that in the intermediate space of the condenser which is provided for by the electrical coatings, the electrical relationships vary during the exposure. The capacitance of the semiconductors is $C_H$ and that of the air gap $C_L$. During illumination, the surface potential $U_c$ of the surface of the semiconductor layer which is applied prior to the exposure, becomes smaller. Averaged over the measuring field, the value $U_o$ drops by a predetermined amount to a potential of value U. This is carried out at a speed −U per unit of time dt.

The change in the potential is caused by an intermediate or median current in the semiconductor $i_H$, which is associated with the voltage change and the capacitance. This results in $-dU/dt = i_H/C_H$ proportional DL, meaning, that the speed of reduction in the surface potential U, respectively, the quotient from the median current flowing in the semiconductor, and the capacitance of the semiconductor, is proportional to the dosage output DL.

On the other hand, there flows in a high-ohmic measuring apparatus also across the capacitance $C_L$ a current $i_L = -C_L \times dU/dt$; in accordance therewith a signal may be tapped off in an inventive arrangement, meaning, a current $i_L = i_H \times C_L/C_H$, and to convert this, through the intermediary of an integrating arrangement, into a charge which is in close association with the effective radiation dosage. Hereby, it is however possible to control the illumination of the exposure. This may generally be carried out whereby the same median charge always streams off in the exposure layer and thereby there are always produced the same charge measurements. This arrangement, in addition to various dosage outputs which are required for different objects and different radiation, also balances or compensates for differently high charges and various semiconductor characteristics. The control is correlated with the particular current exposure system.

In the usual utilization of charged surfaces for the taking of radioscopic pictures, in particular X-ray or gamma radiation pictures, it is advantageous that the electrically conductive coatings be applied to the interior surfaces of a support which is constructed as a cassette. For assured tapping-off of the signals it further is advantageous that terminals be located on the outer surfaces of the cassette. These terminals may have cooperative contacts located oppositely thereto, which are located on the fastening of the cassette on the X-ray apparatus. Thus, in a simple manner there is obtained a constant and assured connection of the electrically conductive layer, which operates as a sensor, with the control installation of the X-ray apparatus. Above all, other connections are also possible such as, for example, by means of a plug connector. Thereby, for many instances, there may be achieved the excellent advantage that the cassette may be appreciably freely moved through the intermediate connection of a cable. The electrically conductive coatings may consist of various materials. Care should be exercised in their selection, however, in particular for those coatings which lie in the direction of the radiation preceding the exposure or photographic layer, that the X-ray, gamma and the like radiation may be readily passed therethrough. Thus, such layers may be obtained in which carbon, for example graphite, is thinly applied. This may be achieved in an extremely simple manner by brushing on a graphite-conductive lacquer. On the other hand, employed as the cooperative electrode may be a suitable layer, for example, a metal layer, such as, for instance an aluminum sheet. Since numerous times the exposure layers are applied onto an electrically conductive layer, such as an aluminum layer, as the cooperative electrode there may also be employed the electrically conductive carrier for the exposure layer. The advantage of a good contact relationship is achieved when at least one electrically conductive surface is provided in the cassette. It is also advantageous that, for purposes of affording this contact, the entire surface be coated with an electrically conductive material, which serves for the support of the exposure plate. Hereby, no special contact devices are required, and it also affords the advantage that at least one of the conductive layers may be divided into a plurality of portions, and these portions may separately be used for effecting the control. This may be carried in a known manner, for example, in the ionization chamber for the illuminating control of X-ray apparatus. Herewith these surface portions are so selected that they encompass the important areas for predetermined exposures, the so-called dominants. The individual surface portions may then be separated as in known ionization chambers, or connected in combination with each other with the control installation. Thus, in correlation with the desired effect, either the entire surface or only selected portions thereof may serve for the generation of the signal.

In the electrophotographic technology, in employing the commonly charged surfaces, this relates to the reduction of the charges, meaning, each incoming radiation intensity delivers a predetermined reduction in the charge. For the obtention of a usable control signal it is therefor necessary that the measured signal be treated in an integrating manner before it is utilized for controlling, since the change in the charge is a function of time.

It is similar in the utilization of a control signal taken from an exposure surface which is insulated and in which there is built up a charge pattern. This is the case in ionography. Also in this instance there is received a varying signal in dependence upon the exposure time.

BRIEF DESCRIPTION OF THE DRAWINGS

Reference may now be had to the following exemplary embodiments of the invention, taken in conjunction with the accompanying drawings; in which.

DETAILED DESCRIPTION

Figure 1:
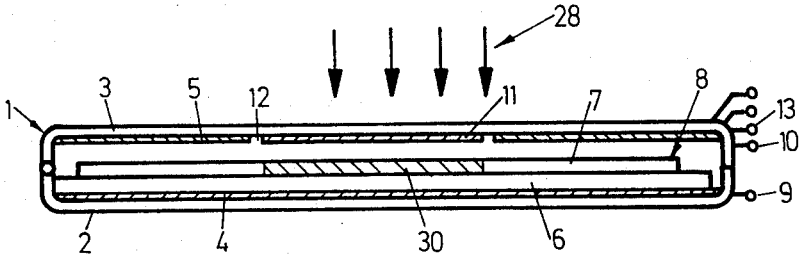
FIG. 1 is a cross-sectional view through a cassette; constructed pursuant to the invention.

Referring now specifically to FIG. 1 of the drawings, there is shown a raisable cassette 1 which is formed of an electrically insulating material, meaning, polyester with glass fibers, polyamide, polystyrol etc., and whose base 2 and cover 3 each, respectively, contain an electrically conductive layer 4 and 5 consisting of a material such as graphite, conductive lacquer, aluminum or the like and which has a thickness of approximately 5 to 20 $\mu$m.

Figure 2:
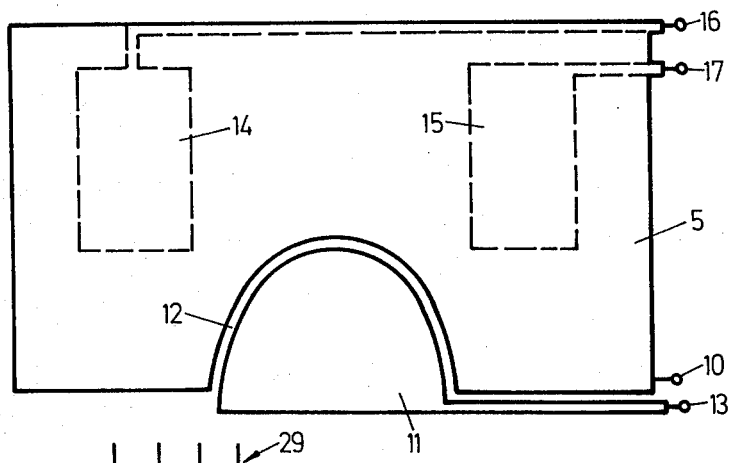
FIG. 2 is a plan view of an electrode which is divided into a plurality of portions.

Located on the electrically conductive layer 4 on the base 2 of the cassette 1 is the approximately 2 mm thick electrically conductive carrier 6, which is formed of a metal such as aluminum, steel, brass or the like, and which has thereon a 150 to 500 $\mu$m thick selenium layer 7 of a xerographic exposure plate 8, and which is charged to 1500 to 5000 volts. The layer 4, as well as the layer 5, each includes a terminal or contact 9 and 10, through the intermediary of which the control signal may be tapped off. Correspondingly, the contact 10 is also illustrated in FIG. 2. Further provided therein, a portion 11 of the layer 5 is separated off through an electrically insulating spacer 12 formed of a highly insulating plastic material such as macrolon, polyamide or the like, and which is of a width of approximately 10 to 50 $\mu$m. The layer has an additional electrical terminal or contact 13. Moreover, indicated in phantom lines are the rectangular areas 14 and 15 which designate the electrically conductive connection to contacts 16 and 17.

Figure 3:
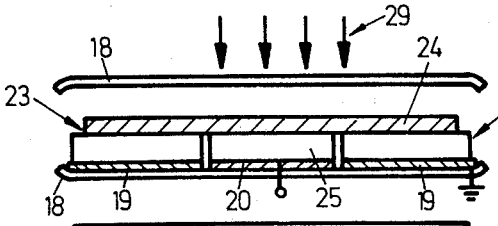
FIG. 3 illustrates an embodiment of the invention in which a carrier for a semiconductor layer employed for the exposure is utilized as an electrode.
Figure 4:
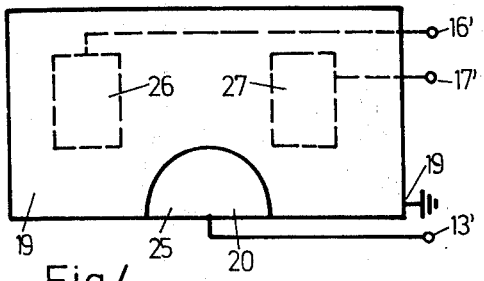
FIG. 4 is a modified embodiment in which the carrier layer of FIG. 3 is divided.

In conformance with the embodiment shown in FIGS. 1 and 2, there may also be provided a configuration as in the embodiment illustrated in FIGS. 3 and 4. The primary distinction between the embodiments consists of in that in this cassette, with otherwise identical shape, the form of the cover 18 is completely flat with a thin electrically conductive electrode constituted of a correspondingly conductive material such as, for example, aluminum, graphite, or the like, and of a thickness of approximately 5 to 10 $\mu$m, and in which allows for the extensive through passage of the X-rays without absorption. On the other side, applied to the cassette base 18' is a conductive layer which is divided into areas 19 and 20 in conformance with the division of the carrier 22 of the xerographic plate 23, which is coated with a 150 to 500 $\mu$m thick selenium layer 24 charged to 1500 to 5000 volts. The separated portion is hereby designated by reference numeral 25. This may also be ascertained from FIG. 4 of the drawings wherein, additionally as in FIG. 2, further rectangular insulatingly applied parts 26 and 27 are shown in phantom lines. The externally conveyed contacts are designated for clarification of identity with the function in FIG. 2, with reference numerals 13', 16' and 17'.

The function generally coincides in the embodiments of FIGS. 1 and 3. By means of impinging penetrating X-rays 28 or, respectively, gamma rays 29, in the semiconductor layer 7 or, respectively, 24 the electrical properties of the otherwise insulating selenium are varied in conformance with the impinging radiation pattern, meaning, there is generated a varied conductivity distribution. This is indicated in FIG. 1 by means of the cross-hatched portion 30 of the layer 7.

Figure 5:
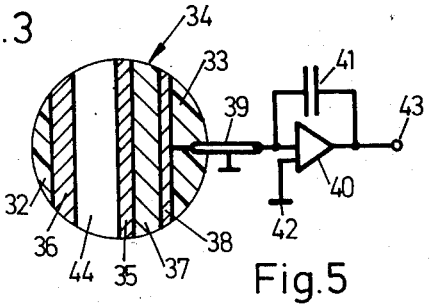
FIG. 5 illustrates a partial sectional view of the inventive cassette, including an integrating arrangement for the signal.

In accordance with the representation in the circular cutout which is illustrated in FIG. 5, the portion of the herewith considered arrangement, consists of a cover 32 and a base 33, a cassette in which there is supported a xerographic plate 34 in a manner so that its semiconductor layer 35 lies at a distance from a conductive layer 36 of graphite having a thickness of 5 to 20 $\mu$m, positioned on the cover 32 which is formed of pressed polyester material. An electrically conductive aluminum carrier 37 for the plate 34 lies in electrical contact with a 20 $\mu$m thick electrically conductive coating 38 formed of graphite, and which is located on the base 33, the latter of which is formed of pressed polyester material. The conductive coating 38 on the base 33 is connected by means of a cable 39, on the one side, with an amplifier element 40, generally an integrating amplifier and, on the other side, with a condenser 41. The second conductor leads through a ground line 42 to the electrically conductive layer 36, the latter of which is similarly grounded. Thereby it becomes possible to tap off a signal from the contact 43, by means of which an X-ray apparatus may be controlled, whereas upon reaching a predetermined charge, the xerographic plate is also discharged by a predetermined amount.

The constructional components in the integrating unit according to FIG. 5 are so arranged, whereby a semiconductor current density of approximately $1 \cdot 10^{-9}$ A/cm$^2$ . mR delivers an adequate signal. For a usual X-ray apparatus, and for the usual utilization of 100 $\mu$m to 600 $\mu$m thick selenium layers, as well as a charge of approximately 1500 volts to approximately 5000 volts, as attained by means of the corona discharge units employed in the usual xerographic apparatus, there are obtained the following magnitudes, meaning at a spacing 44 which has a size of 3 to 8 mm, the components 39, 40 and 41 must have the following dimensions: the cable 39 approximately $10^7\Omega$, the amplifier an amplification of approximately $10^5$ times, and the condenser 41 a capacitance of approximately $10^{-9}$F, so as to achieve an adequate operating function.

Figure 6:
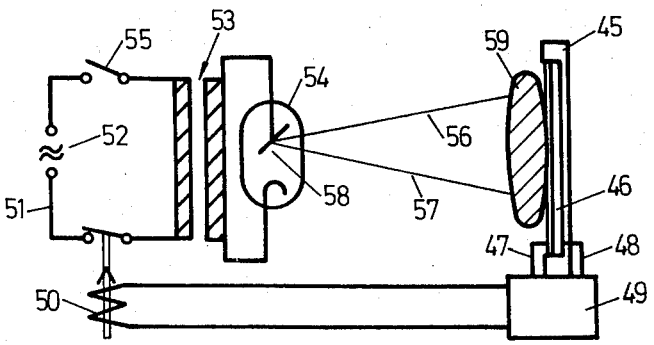
FIG. 6 is a schematic block circuit diagram of an X-ray exposure arrangement in which there is employed the control installation according to the invention.

In FIG. 6 there is illustrated a schematic overall view of an X-ray apparatus. Herein, a support 45 retains a cassette 46 on an X-ray apparatus. The cassette contains, in the above described inventive arrangement, a xerographic plate and, on both sides of this plate, respectively, an electrically conductive layer. These layers are connected with a control apparatus 49 by means of conductors 47 and 48, from which through a relay switch 50, the circuit 51 of a high-voltage generator 52 of the X-ray apparatus belonging to the apparatus which carries out the electrical function, may be switched out-and-in. Employable as the control apparatus 49 is an arrangement as is described in German Patent No. 1,017,709. The apparatus is in electrical conduit with an X-ray tube 54 through a transmitter 53.

Upon the closing of the connection between the source 52 and the transmitter 53 by means of switch

55, there is initiated an electron beam from the anode 58 of the tube 54, as indicated by border lines 56, 57, and which penetrates the body 59 of a patient from which there is then produced a radioscopic picture on the xerographic plate in the cassette 46. The beam hereby penetrates into the cassette as indicated in FIGS. 1 and 3 through the arrows 28 and 29. Therein is produced on one side of the xerographic plate (charged selenium layer), the desired X-ray charge image which may be developed in a known manner. Concurrently, determinable at the electrically conductive layers are changes in the electrical properties which are occasioned by the X-ray beam (56, 57) during the exposure. There are thus obtained, as previously mentioned, through the connectors 47, 48 signals which may be tapped off, by mean of which in the apparatus 49 there is attainable a control of the X-ray exposure in dependence upon all parameters, such as the heaviness of the patient 59, the type of xerographic plate and the cassette, respectively, the materials employed in the construction thereof, which is effected for the exposure. This is effected herein, in that by opening of the relay switch 50, the illumination is terminated through interruption of the operation of the tube 54.

While there has been shown what is considered to be the preferred embodiment of the invention, it will be obvious that modifications may be made which come within the scope of the disclosure of the specification.

What is claimed is:

1. In an arrangement for the electrophotographic taking of radioscopic pictures, including an electrically insulating exposure layer; and support means for retaining said exposure layer in the path of the transilluminating rays, the improvement comprising: a plurality of mutually insulated, electrically conductive layers on said support means, said support means comprising a cassette housing said exposure layer, said electrically conductive layers being coatings formed in the interior walls of said cassette; said exposure layer being located between said electrically conductive layers; means for controlling the source of the penetrating rays, said electrically conductive layers being connected to said source; contact means exteriorly of said cassette; electrically insulating separators dividing said electrically conductive layers into discrete areas; and means electrically connecting said discrete areas with said contact means.

2. In an arrangement for the electro-photographic taking of radioscopic pictures, including an electrically insulating exposure layer; and support means for retaining said exposure layer in the path of the transilluminating rays, the improvement comprising: a plurality of mutually insulated, electrically conductive layers on said support means, said electrically conductive layers comprising carbon coatings, said exposure layer being located between said electrically conductive layers; and means for controlling the source of the penetrating rays, said electrically conductive layers being connected to said source.

* * * * *